US006410217B2

(12) United States Patent
Uehara et al.

(10) Patent No.: US 6,410,217 B2
(45) Date of Patent: Jun. 25, 2002

(54) HEAT-DEVELOPABLE COLOR LIGHT-SENITIVE MATERIAL

(75) Inventors: Kazuki Uehara; Nobuhiro Nishita, both of Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/795,363

(22) Filed: Mar. 1, 2001

(30) Foreign Application Priority Data

Mar. 2, 2000 (JP) ..... 2000-058031

(51) Int. Cl.[7] ..... G03C 8/10; G03C 8/52; G03C 7/36; G03C 7/392

(52) U.S. Cl. ..... 430/523; 430/203; 430/214; 430/351; 430/549; 430/557; 430/961

(58) Field of Search ..... 430/203, 214, 430/226, 351, 549, 557, 523, 961

(56) References Cited

U.S. PATENT DOCUMENTS

| | | | | | |
|---|---|---|---|---|---|
| 3,973,968 | A | * | 8/1976 | Fujiwhara et al. | 430/557 |
| 4,476,219 | A | * | 10/1984 | Sakanove et al. | 430/557 |
| 5,176,987 | A | * | 1/1993 | Nakamura et al. | 430/351 |
| 5,342,742 | A | * | 8/1994 | Naruse et al. | 430/557 |
| 5,354,642 | A | * | 10/1994 | Texter et al. | 430/226 |
| 5,756,268 | A | * | 5/1998 | Draber et al. | 430/351 |
| 6,177,227 | B1 | * | 1/2001 | Nakagawa | 430/203 |

FOREIGN PATENT DOCUMENTS

JP 12-56441 * 2/2000

* cited by examiner

*Primary Examiner*—Richard L. Schilling
(74) *Attorney, Agent, or Firm*—Birch, Stewart, Kolasch & Birch, LLP

(57) ABSTRACT

A heat-developable color light-sensitive material which contains at least, on a support, a light-sensitive silver halide emulsion, a binder, and a dye-providing compound, wherein the light-sensitive material contains at least one compound represented by formula (I) in, for example, a protective layer: formula (I)

wherein $R_1$ is a chlorine atom or an alkoxy group, $R_2$ is an acylamino group or an alkoxycarbonyl group, $R_{11}$ is a hydrogen atom or an alkyl group; $R_{12}$ and $R_{13}$, which are the same or different from, each are a hydrogen atom, an alkyl group or an alkoxy group.

8 Claims, No Drawings

HEAT-DEVELOPABLE COLOR LIGHT-SENITIVE MATERIAL

FIELD OF THE INVENTION

The present invention relates to an excellent heat-developable color light-sensitive material that is less in the variation of fogging with variation of the developing temperature during heat development.

BACKGROUND OF THE INVENTION

Heat-developable light-sensitive materials are known in this field. There are descriptions concerning heat-developable light-sensitive materials and processes thereof in, for example, "Fundamentals of Photographic Engineering," Vol: Non-silver salt photography (published in 1982 from Corona), pp242–255; and U.S. Pat. No. 4,500,626.

In addition to the above, for example, there are descriptions concerning a method of forming a dye image by a coupling reaction between an oxidation product of a developing agent and a coupler, in, for example, U.S. Pat. Nos. 3,761,270 and 4,021,240. Also, there are descriptions concerning a method of forming a positive color image by a light-sensitive silver dye bleaching method, in, for example, U.S. Pat. No. 4,235,957.

Also, a method in which a diffusible dye is released or formed image-wise by thermal-development, and this diffusible dye is transferred to a dye-fixing image-receiving material, has been already put to practical use. In this method, both a negative dye image and a positive dye image can be obtained by changing the type of a dye-providing compound to be used or the type of a silver halide to be used. There are more detailed descriptions in U.S. Pat. Nos. 4,500,626, 4,483,914, 4,503,137 and 4,559,290, JP-A-58-149046 ("JP-A" means unexamined published Japanese patent application), JP-A-60-133449, JP-A-59-218443, JP-A-61-238056, European Patent Application Laid-open No. 220,746A2, Kokai-Giho (Published Technical Report) 87-6199, European Patent Application Laid-open No. 210,660A2, and the like.

Many methods concerning a process for preparing a positive color image by thermal-development have been proposed. For example, U.S. Pat. No. 4,559,290 proposes a method in which a compound, obtained by changing the so-called DRR compound into an oxidized type, having inability to release a color image, and a reducing agent or its precursor, are made to coexist, the reducing agent is oxidized, corresponding to an exposure amount of a silver halide, by thermal-development development, and the compound is reduced by the reducing agent that remains non-oxidized, to release a diffusible dye. Also, in European Patent Application Laid-open No. 220,746A2 and Kokai-Giho 87-6199 (Vol. 12, No. 22), there is a description of a heat-developable color light-sensitive material using a compound that releases a diffusible dye by reductive cleavage of an N—X bond (in which X represents an oxygen atom, a nitrogen atom, or a sulfur atom), as a compound releasing a diffusible dye by the same mechanism as above.

In the meantime, how to restrain fogging during thermal-development is an important point in these heat-developable light-sensitive materials. Reduction in the variation of fogging with variation of the developing temperature during thermal-development is of importance, particularly in consideration of the stability of fogging.

SUMMARY OF THE INVENTION

The present invention is a heat-developable color light-sensitive material which contains at least, on a support, a light-sensitive silver halide emulsion, a binder, and a dye-providing compound, which light-sensitive material contains at least one compound represented by the following formula (I):

formula (I)

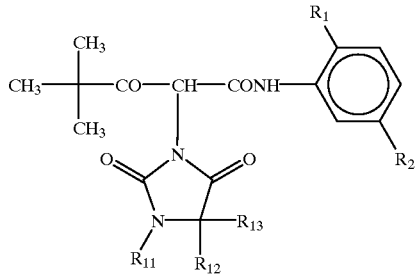

wherein $R_1$ represents a chlorine atom or an alkoxy group, $R_2$ represents an acylamino group or an alkoxycarbonyl group, $R_{11}$ represents a hydrogen atom or an alkyl group, $R_{12}$ and $R_{13}$ each represent a hydrogen atom, an alkyl group or an alkoxy group, in which $R_{12}$ and $R_{13}$ may be the same or different from.

DETAILED DESCRIPTION OF THE INVENTION

According to the present invention there are provided the following means.

(1) A heat-developable color light-sensitive material containing at least, on a support, a light-sensitive silver halide emulsion, a binder, and a dye-providing compound, wherein the light-sensitive material contains at least one compound represented by the following formula (I):

formula (I)

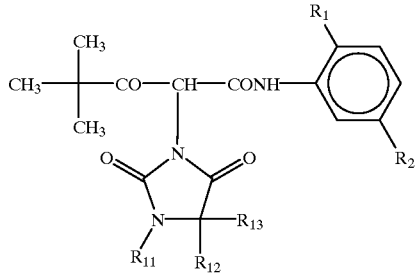

wherein $R_1$ represents a chlorine atom or an alkoxy group, $R_2$ represents an acylamino group or an alkoxycarbonyl group, $R_{11}$ represents a hydrogen atom or an alkyl group, $R_{12}$ and $R_{13}$ each represent a hydrogen atom, an alkyl group, or an alkoxy group, in which $R_{12}$ and $R_{13}$ may be the same or different from each other.

(2) The heat-developable color light-sensitive material according to the above (1), wherein the at least one compound represented by formula (I) is added to a protective layer in an amount of 0.01 mg/m$^2$ or more and 200 mg/m$^2$ or less.

The present invention and its preferable constitutions will be hereinafter explained in detail.

The compound represented by formula (I) that is used in the present invention may be used either singly or in combinations of two or more.

The amount to be added of the compound represented by formula (I) is in a range preferably from 0.01 mg/m$^2$ to 200 mg/m$^2$, and more preferably from 0.01 mg/m$^2$ to 100 mg/m$^2$.

The compound represented by formula (I) may be added to any layer of the light-sensitive material, and it is preferably added to a protective layer. The protective layer referred to herein is a layer most apart from a support, on the side (of the support) to which a silver halide emulsion is applied.

It is preferable that the compound represented by formula (I) has a ballasting group in its molecule, and it is dispersed in an aqueous medium in the state dissolved in a high-boiling point organic solvent, and it is contained in the protective layer.

In the compound represented by formula (I) for use in the present invention, the alkoxy group represented by $R_1$ is an alkoxy group preferably having 1 to 30 carbon atoms, the acylamino group represented by $R_2$ is an acylamino group preferably having 1 to 30 carbon atoms, the alkoxycarbonyl group represented by $R_2$ is an alkoxycarbonyl group preferably having 2 to 31 carbon atoms, the alkyl group represented by $R_{11}$ is an alkyl group preferably having 1 to 30 carbon atoms, the alkyl group represented by $R_{12}$ or $R_{13}$ is an alkyl group preferably having 1 to 30 carbon atoms, and the alkoxy group represented by $R_{12}$ or $R_{13}$ is an alkoxy group preferably having 1 to 30 carbon atoms.

The compound represented by formula (I) for use in the present invention is a compound known, for example, in U.S. Pat. No. 5,342,742; and this compound can be synthesized, for example, according to the preparation method described in JP-A-63-123047.

Specific examples of the compound represented by formula (I) which is used in the present invention are shown below, but these examples do not limit the scope of the present invention.

TABLE 1

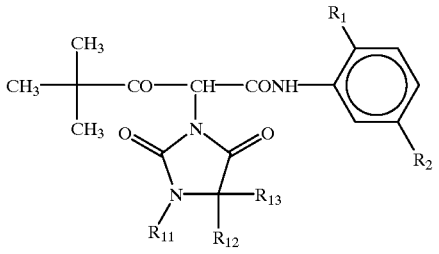

| Compound | $R_1$ | $R_2$ | $R_{11}$ | $R_{12}$ | $R_{13}$ |
|---|---|---|---|---|---|
| 1 | Cl | A | $PhCH_2$ | $CH_3O$ | H |
| 2 | Cl | A | $PhCH_2$ | $C_2H_5O$ | H |
| 3 | Cl | B | $PhCH_2$ | $CH_3O$ | H |
| 4 | Cl | A | H | $CH_3$ | $CH_3$ |
| 5 | Cl | n-$C_{17}H_{35}CONH$ | H | $CH_3$ | $CH_3$ |
| 6 | Cl | n-$C_{17}H_{35}CONH$ | $PhCH_2$ | $C_2H_5O$ | H |
| 7 | $CH_3O$ | A | $PhCH_2$ | $C_2H_5O$ | H |
| 8 | $CH_3O$ | n-$C_{14}H_{29}OCO$ | $CH_3$ | $C_6H_{13}O$ | H |
| 9 | $CH_3O$ | n-$C_{14}H_{29}OCO$ | $CH_3$ | $C_2H_5O$ | H |
| 10 | Cl | $C_8H_{17}CH(C_8H_{17})CONH$ | $PhCH_2$ | $C_2H_5O$ | H |
| 11 | Cl | $C_8H_{17}CH(C_8H_{17})CONH$ | H | $CH_3$ | $CH_3$ |

TABLE 1-continued

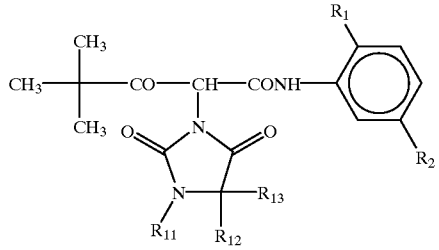

| Compound | $R_1$ | $R_2$ | $R_{11}$ | $R_{12}$ | $R_{13}$ |
|---|---|---|---|---|---|
| A: | (t)-$C_5H_{11}$ | 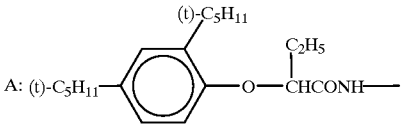 | | | |
| B: | (t)-$C_5H_{11}$ | 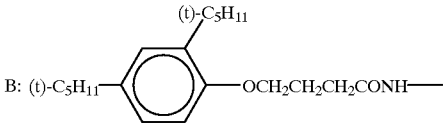 | | | |

The light-sensitive material of the present invention basically comprises a light-sensitive silver halide (emulsion), a binder (preferably a hydrophilic binder), and a dye-providing compound being capable of releasing a diffusible dye corresponding to silver development, on a support, and the light-sensitive material may further contain an organic metal salt oxidant, and the like, according to the need. These components are added to the same one layer in many cases, but they may be divided and added separately to different layers as far as they are in a reactive state.

In the heat-developable light-sensitive material of the present invention, the constitutions other than the aforementioned points may be accorded with the known ones.

In order to obtain a wide range color within the chromaticity diagram by using three primary colors of yellow, magenta and cyan, a combination of at least three silver halide emulsion layers having sensitivity to different spectrum ranges is used. In the present invention, a combination of three layers, specifically, a blue-sensitive layer, a green-sensitive layer and a red-sensitive layer may be generally adopted. Each light-sensitive layer may be arranged in the various orders known in the usual type color light-sensitive materials. Also, each of these light-sensitive layers may be divided into two or more layers according to the need.

In a color-image forming method by the subtractive color process which has been usually used, in particular, a silver halide emulsion (blue-sensitive emulsion) having a spectral sensitivity in a wavelength range from 400 nm to 500 nm is contained in a light-sensitive layer containing a yellow-dye-providing compound (a color-image forming body), a silver halide emulsion (green-sensitive emulsion) spectrally sensitized in a wavelength range from 500 nm to 600 nm is contained in a light-sensitive layer containing a magenta-dye-providing compound (a color-image forming body), and a silver halide emulsion (red-sensitive emulsion) spectrally sensitized in a wavelength range from 600 nm to 740 nm is contained in a light-sensitive layer containing a cyan-dye-providing compound (a color-image forming body). Also, in this case, the yellow-light-sensitive layer is preferably the outermost layer most apart from the support among the light-sensitive layers, since it is colored in a yellow color.

Specifically, this implies a combination of a red-sensitive layer containing a cyan-dye-providing compound, an intermediate layer, a green-sensitive layer containing a magenta-dye-providing compound, an intermediate layer, a blue-sensitive layer containing a yellow-dye-providing compound, an intermediate layer, and a protective layer, which are arranged in this order from the support.

The same characteristics are obtained even if the cyan layer and the magenta layer are arranged in reverse order. Also, each light-sensitive layer may be formed of two layers, each layers of which contains a dye-providing compound and a silver halide emulsion, alternatively in which a silver halide emulsion is contained only in the upper layer and a dye-providing compound is contained also in the lower layer to thereby attain higher sensitization. Also, a light-sensitive material, in which at least one visible-light-sensitive layer is replaced by a infrared-light-sensitive sensitive layer having a maximum spectral light-sensitivity in a wavelength region of 750 nm or more, is also preferred.

In the heat-developable color light-sensitive material, various auxiliary layers, such as a protective layer, an undercoat layer, an intermediate layer, a yellow filter layer, an antihalation layer, and a backing layer, may be provided. When the support is made of polyethylene laminate paper containing a white pigment such as titanium oxide, the backing layer is preferably designed to have antistatic ability and a surface resistivity of $10^{12}$ Ω·cm or less.

The silver halide emulsion for use in the heat-developable color light-sensitive material of the present invention will be hereinafter explained in detail.

The silver halide emulsion that can be used in the present invention may comprise any one of silver chloride, silver bromide, silver bromoiodide, silver chlorobromide, silver chloroiodide and silver chlorobromoiodide. The silver halide emulsion may be either a surface latent image type emulsion or an internal latent image type emulsion. The internal latent image type emulsion is used as a direct reversal emulsion in combination with a nucleus-forming agent and a light-fogging agent. Also, the silver halide emulsion may be the so-called core/shell emulsion having different phases in the inside and surface layer of an individual grain. Silver halides having different compositions may be conjugated by epitaxial junction. The silver halide emulsion may be a monodisperse or a polydisperse; and a method in which monodisperse emulsions are mixed to regulate the gradation, as described in JP-A-1-167743 and JP-A-4-223643, is preferably used. The size of the grain is preferably 0.1 to 2 μm and particularly preferably 0.2 to 1.5 μm. As to the crystal habit of the silver halide grain, any of the followings: silver halide grains having a regular crystal form, such as a cubic, octahedron and tetradecahedron; silver halide grains having an irregular crystal system, such as a spherical or tabular grain having a high aspect ratio; silver halide grains having twin-crystal defects, such as a twin plane; or complex systems of these crystals, is allowed.

Specifically, any one of silver halide emulsions prepared using a method described, for example, in U.S. Pat. No. 4,500,626, column 50, U.S. Pat. No. 4,628,021, J. of Research Disclosure (hereinafter abbreviated to as RD) No. 17,029 (1978), ibid. No. 17,643 (December 1978), pp22–23, ibid. No. 18,716 (November 1979), p648, and ibid. No. 307,105 (November 1989), pp863–865, JP-A-62-253,159, JP-A-64-13,546, JP-A-2-236,546, JP-A-3-110,555, by P. Glafkides, in Chemie et Phisique Photographique, Paul Montel, 1967, by G. F. Duffin, in Photographic Emulsion Chemistry, Focal Press, 1966, and by V. L. Zelikman et al., in Making and Coating Photographic Emulsion, Focal Press, 1964 may be used.

In the light-sensitive material of the present invention, an organic metal salt may be used as an oxidant, together with the light-sensitive silver halide. Among the organic metal salts, an organic silver salt is used particularly preferably. Examples of the organic compound which may be used to form the above organic silver salt as an oxidant, include benzotriazoles, fatty acids and other compounds, as described, for example, in U.S. Pat. No. 4,500,626, columns 52 to 53. Also, silver salts of a carboxylic acid having an alkinyl group, such as silver phenylpropionate, as described in JP-A-60-113235; and silver acetylide as described in JP-A-61-249044 are useful. These organic silver salt may be used in combinations of two or more. The above organic silver salt may be used in an amount of generally 0.01 to 10 mol and preferably 0.01 to 1 mol, per mol of the light-sensitive silver halide. The total amount of the light-sensitive silver halide and the organic silver salt to be applied is generally appropriately 50 mg/$M^2$ to 10 g/$m^2$ in terms of silver.

In the light-sensitive material of the present invention, a variety of antifoggants or photographic stabilizers may be used. Examples of these to be used include azoles and azaindenes, as described in RD 17643 (1978), pp24–25, carboxylic acids and phosphoric acids having nitrogen, as described in JP-A-59-168442, mercapto compounds and metal salts thereof, as described in JP-A-59-111636, and acetylene compounds as described in JP-A-62-87957.

As the reducing agent to be used in the light-sensitive material of the present invention, those known in the fields of light-sensitive materials may be used. Also, dye-providing compounds having reducibility which are described in detail later are also included (in this case, another reducing agent may be used together). A reducing agent precursor which has no reducibility per se, and which develops reducibility by the effect of a nucleophilic reagent or heat in a development step, may also be used.

Examples of the reducing agent that can be used in the light-sensitive material of the present invention include reducing agents and reducing agent precursors, as described, for example, in U.S. Pat No. 4,500,626, columns 49 to 50, U.S. Pat. No. 4,483,914, columns 30 to 31, U.S. Pat. Nos. 4,330,617 and 4,590,152, JP-A-60-140335, pp17–18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, JP-A-62-131256, and European Patent No. 220,746(A2), pp78–96. Combinations of various reducing agents, as disclosed in U.S. Pat. No. 3,039,869, may also be used.

When a non-diffusive reducing agent is used, a combination of an electron-transfer agent and/or an electron-transfer precursor may be used, according to the need, to promote electron transportation between the non-diffusive reducing agent and a developable silver halide. The electron transfer agent or its precursor can be selected from the aforementioned reducing agents and their precursors. It is preferable that the electron transfer agents or their precursors have a higher mobility than the non-diffusive reducing agent (electron donator). Particularly useful electron transfer agents are 1-phenyl-3-pyrazolidones or aminophenols.

As the non-diffusive reducing agent (electron donator) used in combination with the electron transfer agent, any one of the aforementioned reducing agents may be used as far as it is not substantially transferred in layers of the light-sensitive material. Given as preferable examples of the non-diffusive reducing agent are hydroquinones, sulfonamidophenols, sulfonamidonaphthols, compounds described as electron donators in JP-A-53-110827, and non-diffusive and reducible dye-providing compounds explained later. The amount of the reducing agent to be added in the present invention is generally 0.001 to 20 mol and particularly preferably 0.01 to 10 mol, per mol of silver.

In the light-sensitive material of the present invention, ready-made dyes (pigments and dyes) or compounds which form/release a diffusible dye, can be used, as the color-image forming body. In order to form a dye image, for example, the light-sensitive material is made to contain a non-diffusive dye-providing compound, and a diffusible dye is made to be released corresponding to or inversely corresponding to a reaction in which a silver ion (silver halide) is reduced to silver, and then the resultant dye is transferred to a mordant sheet.

As examples of the dye-providing compound which may be used in the light-sensitive material of the present invention, compounds (couplers) which form a dye by an oxidation coupling reaction are first given. This coupler may be either four-equivalent couplers or two-equivalent couplers. Also, the non-diffusive group may form a polymer chain. Specific examples of the color-developing agents and couplers are described in detail, for example, by T. H. James in "The Theory of the Photographic Process" the fourth edition, pp291–334 and pp354–361, in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Other examples which may also be used as the dye-providing compound, include the aforementioned non-diffusive dye-providing compounds (thiazolidine-series type compounds) which have a heterocycle and which release a diffusible dye resulting from a cleavage reaction of the heterocycle containing a nitrogen atom and a sulfur atom or a selenium atom, in the presence of a silver ion or a soluble silver complex, as described, for example, in JP-A-59-180548.

Also, further examples of the dye-providing compound include compounds having the ability to release or diffuse imagewise a diffusible dye. Compounds of this type may be represented by the following formula (LI):

formula (LI)

$(\text{Dye-Y'})_n\text{—Z}$ wherein Dye represents a dye group, a temporarily short-waved dye group or a dye precursor group, Y' represents a single bond or a connecting group, Z represents a group having such an ability as to cause a difference in the diffusibility between the compounds represented by $(\text{Dye-Y'})_n\text{—Z}$ corresponding to or inversely corresponding to a light-sensitive silver salt having a latent image imagewise, or to release the Dye to thereby cause a difference in diffusibility between the released Dye and the $(\text{Dye-Y'})_n\text{—Z}$; n is 1 or 2, when n is 2, two (Dye-Y') groups may be the same or different from.

As specific examples of the dye-providing compound represented by formula (LI), the following compounds ① to ⑤ may be given, wherein the following compounds ① to ③ are those which release a diffusible dye corresponding inversely to the development of a silver halide, and the compounds ④ and ⑤ are those which release a diffusible dye corresponding to the development of a silver halide.

① Dye developing agents obtained by combining a hydroquinone-series developing agent with a dye component, as described, for example, in U.S. Pat. Nos. 3,134,764, 3,362,819, 3,597,200, 3,544,545 and 3,482,972. This dye developing agent is those which are diffusible under an alkaline atmosphere but become non-diffusible when they are reacted with a silver halide.

② Non-diffusible compounds, which release a diffusible dye under an alkaline atmosphere but loses its ability when they are reacted with a silver halide, may also be used, as described in U.S. Pat. No. 4,503,137, and the like. Examples thereof include compounds which release a diffusible dye by an intramolecular nucleophilic substitution reaction, as described in U.S. Pat. No. 3,980,479 and the like, and compounds which release a diffusible dye by an intramolecular reversion reaction of an isoxazolone ring, as described in U.S. Pat. No. 4,199,354 and the like.

③ Non-diffusible compounds which react with a reducing agent that remains to be non-oxidized by development, to thereby release a diffusible dye, as described, for example, in U.S. Pat. No. 4,559,290, European Patent No. 220,746 (A2), U.S. Pat. No. 4,783,396 and Kokai-Giho 87-6199, may also be used.

Examples thereof include compounds which release a diffusible dye by an intramolecular nucleophilic substitution reaction after being reduced, as described, for example, in U.S. Pat. Nos. 4,139,389 and 4,139,379, JP-A-59-185333 and JP-A-57-84453, compounds which release a diffusible dye by an intramolecular electron-transfer reaction after being reduced, as described, for example, in U.S. Pat. No. 4,232,107, JP-A-59-101649, JP-A-61-88257 and RD24025 (1984), compounds which release a diffusible dye by the cleavage of a single bond after being reduced, as described, for example, in West German Patent No. 3,008,588A, JP-A-56-142530, U.S. Pat. Nos. 4,343,893 and 4,619,884, nitro compounds which release a diffusible dye after the receipt of electrons, as described in U.S. Pat. No. 4,450,223 and the like, and compounds which release a diffusible dye after the receipt of electrons, as described in U.S. Pat. No. 4,609,610.

More preferable examples include compounds having an N—X bond (X represents an oxygen, sulfur or nitrogen atom) and an electron-attractive group in one molecule, as described, for example, in European Patent No. 220,746 (A2), Kokai-Giho 87-6199, U.S. Pat. No. 4,783,396, JP-A-63-201653 and JP-A-63-201654, compounds having $SO_2$—X (X has the same meaning as defined above) and an electron-attractive group in one molecule, as described in JP-A-1-26842, compounds having a PO—X bond (X has the same meaning as defined above) and an electron-attractive group in one molecule, as described in JP-A-63-271344, and compounds having a C—X' bond (X' has the same meaning as X, or X' represents —$SO_2$—) and an electron-attractive group in one molecule, as described in JP-A-63-271341. Compounds which release a diffusible dye after being reduced to cause the cleavage of a single bond by a $\pi$ bond that conjugates with an electron acceptable group, as described in JP-A-1-1612371 and JP-A-1-161342, may also be utilized.

Among these compounds, compounds having an N—X bond and an electron-attractive group in one molecule is preferable in particular. Specific examples of the preferable compounds include the compounds (1) to (3), (7) to (10), (12), (13), (15), (23) to (26), (31), (32), (35), (36), (40), (41), (44), (53) to (59), (64) and (70) described in U.S. Pat. No. 4,783,396 or European Patent No. 220,746 (A2), and the compounds (11) to (23) described in Kokai-Giho 87-6199.

④ Compounds (DDR couplers) which are couplers having a diffusible dye as a split-off group and which release a diffusible dye by a reaction with an oxidation product of a reducing agent. Specific examples include those described, for example, in U.K. Patent No. 1,330,524, JP-B-48-39165 ("JP-B" means examined Japanese patent publication), U.S. Pat. Nos. 3,443,940, 4,474,867 and 4,483,914.

⑤ Compounds (DRR compounds) which can reduce a silver halide or an organic silver salt and release a diffusible dye when they reduce a counter compound. Because this compound requires no other reducing agent, it is free from such a problem of contamination to an image which contamination is caused by an oxidation decomposed product of the reducing agent, and it is therefore preferable. Specific examples thereof are described, for example, in U.S. Pat. Nos. 3,928,312, 4,053,312, 4,055,428 and 4,336,322, JP-A-59-65839, JP-A-59-69839, JP-A-53-3819, JP-A-51-104343, RD17465, U.S. Pat. Nos. 3,725,062, 3,728,113 and 3,443,939, JP-A-58-116537, JP-A-57-179840 and U.S. Pat. No. 4,500,626. Specific examples of the DRR compound may include compounds described in the aforementioned U.S. Pat. No. 4,500,626, columns 22 to 44. Among these compounds, compounds (1) to (3), (10) to (13), (16) to (19), (28) to (30), (33) to (35), (38) to (40) and (42) to (64), as described in the above U.S. Patent, are preferable. The compounds described in U.S. Pat. No. 4,639,408, columns 37 to 39 are also useful.

In addition to the above, as dye-providing compounds besides the aforementioned couplers and the compounds represented by the formula (LI), dye silver compounds in which an organic silver salt is linked with a dye (e.g., J. of Research Disclosure (RD), May 1978, pp54–58), azo dyes used in a thermal development silver dye bleaching method (e.g., U.S. Pat. No. 4,235,957 and J. of Research Disclosure, April 1976, pp30–32), leuco dyes (U.S. Pat. Nos. 3,985,565 and 4,022,617) or the like, may also be used. In the present invention, the aforementioned DRR compounds are used particularly preferably.

Hydrophobic additives, such as the dye-providing compound and the non-diffusive reducing agent, may be introduced into a layer of the light-sensitive element, by a known method, such as a method described in U.S. Pat. No. 2,322,027. In this case, a high-boiling point organic solvent, as described in JP-A-59-83154, JP-A-59-178451, JP-A-59-178452, JP-A-59-178453, JP-A-59-178454, JP-A-59-178455, JP-A-59-178457 or the like, may be used in combination with a low-boiling point organic solvent having a boiling point of 50 to 160° C., according to the need.

The amount of the high-boiling point organic solvent is generally 10 g or less and preferably 5 g or less, per g of the dye-providing compound to be used. The amount of the-high-boiling point organic solvent is appropriately generally 1 ml or less, preferably 0.5 ml or less, and particularly preferably 0.3 ml or less, per g of the binder. The dispersion method using a polymer, as described in JP-B-51-39853 and JP-A-51-59943, may also be used. In the case of a compound which is substantially insoluble in water, it may be dispersed and contained in the binder in the form of fine particles, instead of using the above methods.

When the hydrophobic compounds are dispersed in a hydrophilic colloid as the binder, a variety of surfactants may be used. For example, those exemplified as the surfactant in JP-A-59-157636, pp37–38 and Research Disclosure explained later may be used. Phosphate type surfactants described in JP-A-7-056267, JP-A-7-228589 and West Germany Patent Application Laid-open No. 1,932,299A may also be used.

In the present invention, a compound which promotes both the activation of development and the stabilization of an image may be used in the light-sensitive material. Specific preferable examples of the compound to be used are described in U.S. Pat. No. 4,500,626, columns 51 to 52.

The dye-fixing material used for the processing of the light-sensitive material of the present invention may have either a constitution in which it is formed by application on a separate support differing from that used for the light-sensitive material or a constitution in which it is formed by application on the same support that was used for the light-sensitive material. The relationship between the light-sensitive material and the dye-fixing material, the relationship with the support, and the relationship with the white-color reflecting layer is described in U.S. Pat. No. 4,500,626, column 57 and these relationships may also be applied to the present invention. Because of inclusion of the constitution in which the light-sensitive material and the dye-fixing material are formed by application on the same support, the light-sensitive material is sometimes explained using the term light-sensitive element or photographic element, while the dye-fixing material is sometimes explained using the term "image-receiving element" or "dye-fixing element", for the sake of convenience.

The dye-fixing material which is preferably used in the present invention has at least one layer containing a mordant and a binder. As the mordant, one known in the photography fields may be used. As specific examples of the mordant, mordants described in U.S. Pat. No. 4,500,626, columns 58 to 59 and JP-A-61-88256, pp32–41, and those described in JP-A-62-244043 and JP-A-62-244036 may be given. Also, a dye-receivable polymer compound as described in U.S. Pat. No. 4,463,079 may be used. Auxiliary layers including a protective layer, a peeling layer, and a curling preventive layer may be provided in the dye-fixing material according to the need. The formation of a protective layer is particularly useful.

As the binder used in the structural layer of the light-sensitive element or dye-fixing material, hydrophilic ones are preferably used. As examples of the binder, those described in JP-A-62-253159, pp26–28 are given. Specifically, transparent or semi-transparent hydrophilic binders are preferable. As examples of the hydrophilic binder, natural compounds, such as proteins, e.g. gelatin and gelatin derivatives, or cellulose derivatives, or polysaccharides, e.g., starch, gum arabic, dextran and pluran; and synthetic polymer compounds, such as polyvinyl alcohols, polyvinylpyrrolidones and acrylamide polymers, are given. High water-absorptive polymers described in JP-A-62-245260, specifically, homopolymers of vinyl monomers having —COOM or —$SO_3M$ (M represents a hydrogen atom or an alkali metal), or copolymers of these vinyl monomers among them or with another vinyl monomer (e.g., sodium methacrylates, ammonium methacrylates, and Sumikagel L-5H, trade name, manufactured by Sumitomo Kagaku Co., Ltd.) can also be used. These binders may be used in combinations of two or more.

When a slight amount of water is supplied to carry out thermal development, the absorption of water can be rapidly carried out using the aforementioned high water-absorptive polymer. Also, the use of the high water-absorptive polymer in the mordant layer or its protective layer can prevent a dye from re-transferring from the mordant element to other elements after the dye is transferred.

Known photographic additives which may be used for the heat-developable light-sensitive material or the dye-fixing material are described in the aforementioned RD No.

17,643, RD No. 18,716 and RD No. 307,105. The places of corresponding passages are listed in the following table.

| | Kind of Additive | RD 17643 | RD 18716 | RD 307105 |
|---|---|---|---|---|
| 1 | Chemical sensitizers | p.23 | p.648 (right column) | p.866 |
| 2 | Sensitivity-enhancing agents | | p.648 (right column) | |
| 3 | Spectral sensitizers and Supersensitizers | pp.23–24 | pp.648 (right column)–649 (right column) | pp.866–868 |
| 4 | Brightening agents | p.24 | pp.648 (right column) | p.868 |
| 5 | Antifogging agents and Stabilizers | pp.24–25 | p.649 (right column) | pp.868–870 |
| 6 | Light absorbers, Filter dyes, and UV Absorbers | pp.25–26 | pp.649 (right column)–650 (left column) | p.873 |
| 7 | Dye-image stabilizers | p.25 | p.650 (left column) | p.872 |
| 8 | Hardeners | p.26 | p.651 (left column) | pp.874–875 |
| 9 | Binders | p.26 | p.651 (left column) | pp.873–874 |
| 10 | Plasticizers and Lubricants | p.27 | p.650 (right column) | p.876 |
| 11 | Coating aids and Surfactants | pp.26–27 | p.650 (right column) | pp.875–876 |
| 12 | Antistatic agents | p.27 | p.650 (right column) | pp.876–877 |
| 13 | Matt agents | | | pp.878–879 |

In the present invention, as examples of the support for the light-sensitive material or dye-fixing material, photographic supports, such as paper or synthetic polymers (films), as described in "Fundamentals of Photographic Engineering" Vol: Non-silver salt photography (edited by Nihon Shasin Gakkai and published from Corona, 1979), pp223–240 are given. Specific examples which can be used include polyethylene terephthalates (PETs), polyethylene naphthalates, polycarbonates, polyvinyl chlorides, polystyrenes, polypropylenes, polyimides, celluloses (e.g., triacetyl cellulose); or those prepared by allowing these films to contain a pigment, such as titanium oxide; papers synthesized by a filming process from a polypropylene; mixed papers made from a synthetic resin pulp, such as a polyethylene, and a natural pulp; Yankee papers, baryta papers, coated papers (cast-coated papers in particular), metals, clothes, glasses, and ceramics. These materials may be used singly. Also, a support prepared by laminating a synthetic polymer, such as a polyethylene, PET, polyester or polystyrene, on one or both of the surfaces thereof may be used.

Besides the aforementioned supports, various supports as described, for example, in JP-A-62-253159, pp(29)–(31), JP-A-1-161236, pp(14)–(17), JP-A-63-316848, JP-A-2-22651, JP-A-3-56955 and U.S. Pat. No. 5,001,033 may be used.

A hydrophilic binder and a semiconductive metal oxide, such as an alumina sol and tin oxide, carbon black, or other antistatic agents may be applied on the surface of the support. Also, it is also preferable to apply a gelatin and a polymer such as a PVA, to the surface of the support previously, with the intention of improving the wettability of a coating solution and the adhesion between the applied film and the support.

The thickness of the support varies according to the purpose in use, and a thickness of 40$\mu$m or more and 400 $\mu$m or less is generally adopted. However, in the case of a method of forming an image by using elements applied to two or more separate supports, a support with a thickness (5 $\mu$m or more and 250 $\mu$m or less) lower than the above range is preferably used as the support on the side where the image on the element is not finally used. As such a thin support, for example, a film obtained by depositing aluminum on a PET can be used.

In the case where strict requirements for heat resistance and curling characteristics must be fulfilled, supports for use in a light-sensitive material, as described, for example, in JP-A-6-41281, JP-A-6-43581, JP-A-6-51426, JP-A-6-51437, JP-A-51442, JP-A-6-82961, JP-A-6-82960, JP-A-6-82959, JP-A-6-67346, JP-A-6-202277, JP-6-175282, JP-A-6-118561, JP-A-7-219129, JP-A-7-219144 or the like, may be preferably used.

Example of methods for exposing the light-sensitive material image-wise to thereby record the image include a method in which a light emitting diode or various lasers is allowed to emit light on the basis of image information through electric signals thereby exposing the light-sensitive material, and a method in which image information is output on an image display device such as a CRT, liquid crystal display, electroluminescence display or plasma display, to expose the light-sensitive material either directly or through an optical system. A method, in which a plurality of point light sources, such as LEDs or LDs, are arranged, to expose a plurality of pixels at the same time, is also preferably used as a rapid writing method.

In order to record an image in the light-sensitive material, a light source, such as natural light, a tungsten lamp, a light-emitting diode, a laser light source or a CRT light source, and an exposure method and a light source as described in U.S. Pat. No. 4,500,626, column 56, JP-A-2-53378 and JP-A-2-54672 may be used as aforementioned. Also, a light source using a blue-light emitting diode, which has been remarkably developed in recent years, in combination with a green-light emitting diode and a red-light emitting diode may be used. Particularly, exposure apparatuses described in JP-A-7-140567, JP-A-7-248549, JP-A-7-248541, JP-A-7-295115, JP-A-7-290760, JP-A-7-301868, JP-A-7-301869, JP-A-7-306481 and JP-A-8-15788 may be preferably used.

A waveform conversing element in which a nonlinear optical material is combined with a coherent light source such as laser light may be used to carry out image exposure. Herein, the nonlinear optical material means materials which can develop nonlinearity in the relationship between the polarization and the electric field, the nonlinearity appearing when a strong photoelectric field like laser light is applied. Inorganic compounds represented by lithium niobate, potassium dihydrogen phosphate (KDP), lithium iodate and $BaB_2O_4$ urea derivatives, nitroaniline derivatives, nitropyridine-N-oxide derivatives such as 3-methyl-4-nitropyridine-N-oxide (POM), or compounds described in JP-A-61-53462 and JP-A-62-210432 can be preferably used. As the type of waveform conversing elernent, a monocrystal light waveguide type or a fiber type have been known and these types are all useful.

Also, for the aforermentioned image information, image signals obtained from video cameras, electronic still cameras and the like, television signals represented by Nihon Television Signal Standard (NTSC), image signals obtained by dividing an original image into a large number of pixels such as scanners, and image signals made using a computer represented by CGs or CADs may be utilized. The image-forming material (the light-sensitive material and/or the dye-fixing material) of the present invention may be used in various applications. For example, the dye-fixing material obtained after heat-development transfer may be used as a positive or negative type color print material. Also, the light-sensitive material can be used as black-and-white positive or negative type print materials, printing materials such as lithographic light-sensitive materials, or photographic materials for Roentgen photography, by using a light-sensitive material which uses a mixed material of a black dye-providing material or materials providing yellow, magenta and cyan dyes, respectively.

When the image-forming material of the present invention is used, particularly, as a material printed from a shooting material, it is preferable that using a shooting material having the ability to record information, as described in JP-A-6-163450 or JP-4-338944, the light-sensitive material of the present invention be exposed to make a print on the dye-fixing material of the present invention by heat-development transfer. As this printing method, a method described in JP-A-5-241251, JP-A-5-19364 or JP-A-5-19363 may be used. Also, the heat-development transferred light-sensitive material may be used as a shooting material by desilvering the light-sensitive material appropriately. In this case, it is preferable to record shooting information and the like, by using a support having a magnetic substance layer, as described in, for example, JP-A-4-124645, JP-A-5-40321, JP-A-6-35092 or JP-A-6-317875, as the support.

The light-sensitive material and/or the dye-fixing material of the present invention may have a constitution having an electroconductive heating element layer as heating means used for heat-development and the diffusion transfer of a dye. As the heating element in this case, those described in JP-A-61-145544 and the like may be used.

Heating temperature in the thermal development step is generally about 50° C. to 250° C. and particularly preferably about 60° C. to 180° C. A step of diffusion transfer of a dye may be performed either together with thermal development or after the thermal development step is finished. In the latter case, it is possible to transfer the dye at temperatures ranging from the temperature adopted in the thermal development step to ambient temperature, as to the heating temperature in the transfer step. However, the heating temperature is preferably 50° C. or more and lower by about 10° C. than the temperature of the thermal development step.

The migration of the dye is caused by only heat, and a solvent may be used to promote the migration of the dye. A method in which the development and the transfer are carried out either simultaneously or successively under heating in the presence of a small amount of a solvent (especially, water), as described in U.S. Pat. Nos. 4,704,345 and 4,740,445, JP-A-61-238056, and the like, is also useful. In this system, the heating temperature is preferably 50° C. or more and equal to or lower than the boiling point of the solvent. When the solvent is, for example, water, the temperature is preferably 50° C. to 100° C.

Examples of the solvent to be used for the promotion of development and/or the diffusion transfer of the dye include water, an aqueous basic solution containing an inorganic alkali metal salt or an organic base (as the base, those described in the paragraph concerning the image forming promoter are used), a low-boiling point solvent, or a mixed solution of a low-boiling point solvent and water or the above aqueous basic solution. Also, a surfactant, an antifoggant, a complex-forming compound with a metal salt which is sparingly soluble in water, a mildew-proofing agent, and/or an antibacterial agent may be contained in the solvent.

As the solvent to be used in these thermal development and diffusion transfer steps, water is preferably used. As the water, any water which is generally used may be used. Specifically, distilled water, city (tap) water, well water, mineral water or the like may be used. In a thermal development apparatus using the image-forming material (the light-sensitive material and the dye-fixing material) of the present invention, water may be used either in a non-returnable system or repeatedly in a circulatory system. In the latter case, water containing components eluted from materials is eventually used. Also, an apparatus and water described in JP-A-63-144354, JP-A-63-144355, JP-A-62-38460, JP-A-3-210555 and the like may be used. Each of these solvents may be used in a method in which it is supplied to the light-sensitive material, it is supplied to the dye-fixing material or it is supplied to the both of these materials. The amount of the solvent to be used may be equal to or less than the mass of the solvent corresponding to the maximum swelling volume of the whole coated film.

To supply this water, a method described in, for example, JP-A-62-253159, page (5) or JP-A-63-85544 is preferably used. Also, the solvent may be used by encapsulating it in a microcapsule, or by allowing the light-sensitive material, the dye-fixing element or the both, to build-in it in the form of a hydrate in advance. The temperature of the water to be supplied may be 30 to 60° C. as described in the aforementioned JP-A-63-85544 and the like.

In order to promote the migration of the dye, a system may be adopted in which the light-sensitive material and/or the dye-fixing material are allowed to build-in a hydrophilic heat solvent which is a solid at ambient temperature and melted at high temperatures. Although the layer which builds-in the solvent may be any one of the light-sensitive silver halide emulsion layer, intermediate layer, protective layer and dye-fixing layer, the dye-fixing layer and/or a layer adjacent thereto are preferable. Examples of the hydrophilic heat solvent include ureas, pyridines, amides, sulfonamides, imides, alcohols, oximes and other heterocycles.

The heating method in the development and/or transfer steps include a method in which the light-sensitive material is brought into contact with a heated block or plate, a method in which the light-sensitive material is made to be in contact with a hot plate, a hot presser, a heat roller, a heat drum, a halogen lamp heater, or an infrared or far infrared lamp heater, and a method in which the light-sensitive material is made to pass through a high temperature atmosphere. As a method of overlapping the light-sensitive material on the dye-fixing material, a method described in JP-A-62-253159 or JP-A-61-147244, page (27) may be applied.

For the processing of the photographic element of the present invention, any one of various development apparatuses may be used if necessary. For example, apparatuses described in JP-A-59-75247, JP-A-59-177547, JP-A-59-181353, JP-A-60-18951, JU-A-62-25944 ("JU-A" means unexamined published Japanese utility-model application), JP-A-6-130509, JP-A-6-95338, JP-A-6-95267, JP-A-8-29955, and JP-A-8-29954 and the like are preferably used. Also, as commercially available apparatus, for example, Pictrostat 100, Pictrostat 200, Pictrostat 300, Pictrostat 330, Pictrography 3000 and Pictrography 4000 (trade names, manufactured by Fuji Photo Film Co., Ltd.) may be used.

The heat-developable color light-sensitive material of the present invention exhibits such an excellent effect that the occurrence of fogging depending on variation of the developing temperature during thermal development is less.

The present invention will be explained in more detail based on the folowing examples, which are not intended to be limiting of the present invention.

EXAMPLE

Example 1

Method for the production of light-sensitive silver halide emulsions will be explained.

Light-sensitive silver halide (1) (an emulsion for the 7th layer (680-nm-light-sensitive layer))

Solutions (I) and (II) having the compositions shown in Table 3 were added at the same time to an aqueous solution having the composition shown in Table 2, which solution was stirred well, over 19 minutes. After 5 minutes, a solution (III) having the composition shown in Table 3 was added over 33 minutes, and a solution (IV) was added over 33 minutes and 30 seconds, respectively.

TABLE 2

| Composition | |
|---|---|
| $H_2O$ | 620 ml |
| Lime-processed gelatin | 20 g |
| KBr | 0.3 g |
| NaCl | 2 g |
| Silver halide solvent ① | 0.030 g |
| Sulfuric acid (1N) | 16 ml |
| Temperature | 45° C. |

Silver halide solvent ①

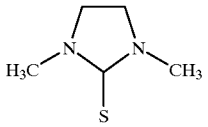

TABLE 3

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_2IrCl_6$ | — | — | — | 0.039 mg |
| Total volume | water to make 126 ml | water to make 132 ml | water to make 254 ml | water to make 252 ml |

150 ml of an aqueous solution containing 0.350% of a sensitizing dye ① was added over 27 minutes, 15 minutes after the addition of the solution (III) was started.

Sensitizing dye ①

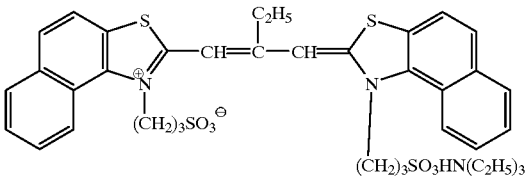

After the resultant mixture was washed and desalted (at a pH of 3.7 to 4.1 by using a settling agent a) by a usual method, 22 g of a lime-processed ossein gelatin was added, and the resulting mixture was adjusted to pH 6.0 and pAg 7.9 and then chemically sensitized at 60° C. Compounds used for the chemical sensitization are as shown in Table 4. The thus-obtained emulsion was yielded in a yield of 630 g and was a monodispersion cubic silver chlorobromide emulsion having a coefficient of variation of 10.2% and an average grain size of 0.20 μm.

Settling agent a.

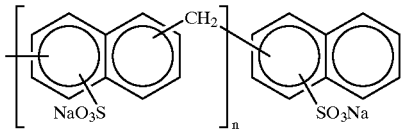

TABLE 4

| Chemicals used in chemical sensitization | Added amount |
|---|---|
| 4-hydroxy-6-methyl-1,3,3a,7-tetrazaindene | 0.36 g |
| Sodium thiosulfate | 6.75 mg |
| Antifoggant ① | 0.11 g |
| Antiseptic ① | 0.07 g |
| Antiseptic ② | 3.13 g |

Antifoggant ①

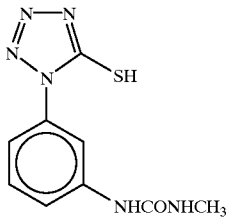

Antiseptic ①

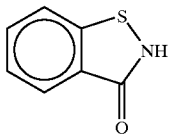

Antiseptic ②

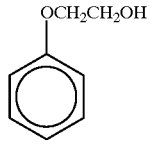

Light-sensitive silver halide emulsion (2) (an emulsion for the 5th layer (750-nm-light-sensitive layer))

Solutions (I) and (II) having the compositions shown in Table 6 were added at the same time to an aqueous solution having the composition shown in Table 5, which solution was stirred well, over 18 minutes. After 5 minutes, a solution (III) having the composition shown in Table 6 was added over 24 minutes, and a solution (IV) was added over 24 minutes and 30 seconds, respectively.

TABLE 5

| Composition | |
|---|---|
| $H_2O$ | 620 ml |
| Lime-processed gelatin | 20 g |
| KBr | 0.3 g |
| NaCl | 2 g |
| Silver halide solvent ① | 0.030 g |

TABLE 5-continued

| Composition | |
|---|---|
| Sulfuric acid (1N) | 16 ml |
| Temperature | 45° C. |

TABLE 6

| | Solution I | Solution II | Solution III | Solution IV |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_4[Fe(CN)_6]H_2O$ | — | — | — | 0.065 g |
| $K_2IrCl_6$ | — | — | — | 0.040 mg |
| Total volume | water to make 188 ml | water to make 188 ml | water to make 250 ml | water to make 250 ml |

After the resultant mixture was washed and desalted (at a pH of 3.9 by using a settling agent b) by a usual method, 22 g of a lime-processed ossein gelatin from which calcium was removed off (the content of calcium: 150 ppm or less) was added thereto and the resultant mixture was re-dispersed at 40° C. 0.39 g of 4-hydroxy-6-methyl-1,3,3a,7-tetrazainedene was added thereto, and the resulting mixture was adjusted to pH 5.9 and pAg 7.8 and then chemically sensitized at 70° C. Compounds used for the chemical sensitization are as shown in Table 7. A methanol solution of a sensitizing dye ② (a solution having the composition shown in Table 8) was added in the course of the chemical sensitization. The temperature was dropped to 40° C. after the chemical sensitization. Then, 200 g of a gelatin dispersion of a stabilizing agent ① shown below was added, followed by stirring well and the resulting product was stored in a housing. The resulting emulsion was yielded in a yield of 938 g and was a monodispersion cubic silver chlorobromide emulsion having a coefficient of variation of 12.6% and an average grain size of 0.25 μm.

TABLE 7

| Chemicals used in chemical sensitization | Added amount |
|---|---|
| 4-hydroxy-6-methyl-1,3,3a,7-tetrazaindene | 0.39 g |
| Triethylthiourea | 3.3 mg |
| Nucleic acid decomposition product | 0.39 mg |
| NaCl | 0.15 g |
| KI | 0.12 g |
| Antifoggant ② | 0.10 g |
| Antiseptic ① | 0.07 g |

TABLE 8

| Composition of dye solution | Added amount |
|---|---|
| Sensitizing dye ② | 0.19 g |
| Methanol | 18.7 ml |

Stabilizer ①

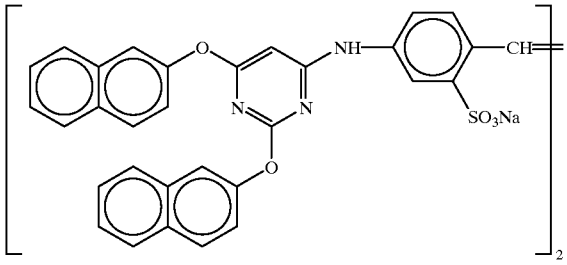

Antifoggant ②

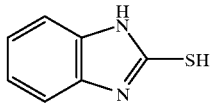

Settling agent b.

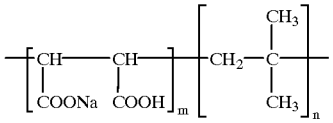

Sensitizing dye ②

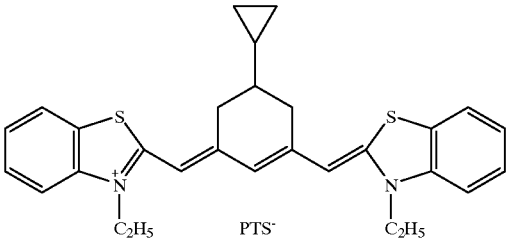

PTS: Paratoluene sulfonic acid

Light-sensitive silver halide emulsion (3) (an emulsion for the 3th layer (810-nm-light-sensitive layer))

Solutions (I) and (II) having the compositions shown in Table 10 were added at the same time to an aqueous solution having the composition shown in Table 9, which solution was stirred well, over 18 minutes. After 5 minutes, a solution (III) having the composition shown in Table 10 was added over 24 minutes, and a solution (IV) was added over 24 minutes and 30 seconds, respectively.

TABLE 9

| Composition | |
|---|---|
| $H_2O$ | 620 ml |
| Lime-processed gelatin | 20 g |
| KBr | 0.3 g |
| NaCl | 2 g |
| Silver halide solvent ① | 0.030 g |
| Sulfuric acid (1N) | 16 ml |
| Temperature | 50° C. |

TABLE 10

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.6 g | — | 2.4 g |
| $K_2IrCl_6$ | — | — | — | 0.020 g |
| $K_4[Fe(CN)_6]H_2O$ | — | — | — | 0.04 g |
| Total volume | water to make 180 ml | water to make 181 ml | water to make 242 ml | water to make 250 ml |

After the resulatant mixture was washed and desalted (at a pH of 3.8 by using a settling agent a) by a usual method, 22 g of a lime-processed ossein gelatin was added, and the resulting mixture was adjusted to pH 7.4 and pAg 7.8 and then chemically sensitized at 60° C. Compounds used for the chemical sensitization are as shown in Table 11. The thus-obtained emulsion was yielded in a yield of 683 g and was a monodispersion cubic silver chlorobromide emulsion having a coefficient of variation of 9.7% and an average grain size of 0.32 μm.

TABLE 11

| Chemicals used in chemical sensitization | Added amount |
|---|---|
| 4-hydroxy-6-methyl-1,3,3a,7-tetrazaindene | 0.38 g |
| Triethylthiourea | 3.10 mg |
| Antifoggant (2) | 0.19 g |
| Antiseptic (1) | 0.07 g |
| Antiseptic (2) | 3.13 g |

A method of production of a fine-grain silver chloride grains to be added to the 3rd layer (810-nm-light-sensitive layer) will be explained.

Solutions (I) and (II) having the compositions shown in Table 13 were added at the same time to an aqueous solution having the composition shown in Table 12, which solution was stirred well, over 4 minutes. After 3 minutes, solutions (III) and (IV) having the compositions shown in Table 13 were added over 8 minutes.

TABLE 12

| Composition | |
|---|---|
| $H_2O$ | 3770 ml |
| Lime-processed gelatin | 60 g |
| NaCl | 0.8 g |
| Temperature | 38° C. |

TABLE 13

| | Solution (I) | Solution (II) | Solution (III) | Solution (IV) |
|---|---|---|---|---|
| $AgNO_3$ | 300 g | — | 300 g | — |
| $NH_4NO_3$ | 10 g | — | 10 g | — |
| NaCl | — | 108 g | — | 104 g |
| Total volume | water to make 940 ml | water to make 940 ml | water to make 1170 ml | water to make 1080 ml |

After the resultant mixture was washed and desalted (at a pH of 3.9 by using a settling agent a) by a usual method, 132 g of a lime-processed gelatin was added thereto and the resultant mixture was re-dispersed at 35° C. 4 g of 4-hydroxy-6-methyl-1,3,3a,7-tetrazainedene was added thereto, and the resulting mixture was adjusted to pH 5.7. The resulting silver chloride fine grain emulsion was yielded in a yield of 3,200 g and had an average grain size of 0.10 μm.

A method of preparing a gelatin dispersion of colloidal silver will be explained.

A solution having the composition shown in Table 15 was added to an aqueous solution, which had the composition shown in Table 14 and was stirred well, over 24 minutes. After the mixture was washed using a settling agent a, 43 g of a lime-processed ossein gelatin was added thereto, and the resultant mixture was adjusted to pH 6.3. The resulting emulsion had an average grain size of 0.02 μm and was yielded in a yield of 512 g (a dispersion containing 2% of silver and 6.8% of gelatin).

TABLE 14

| Composition | |
|---|---|
| $H_2O$ | 620 ml |
| Dextrin | 16 g |
| NaOH(5N) | 41 ml |
| Temperature | 30° C. |

TABLE 15

| Composition | |
|---|---|
| $H_2O$ | 135 ml |
| $AgNO_3$ | 17 g |

A method of preparing a gelatin dispersion of hydrophilic additive will be explained.

A gelatin dispersion of the compound (2) described in the specification was prepared according to the formulation shown in Table 16. Specifically, the oil phase components were heated to about 60° C. to dissolve them. To this solution, were added the aqueous phase components heated to about 60° C., followed by stirring to mix together. The resultant mixture was then dispersed using a homogenizer at 10,000 rpm for 10 minutes, to obtain a uniform dispersion. Further ethyl acetate was removed off from the resulting dispersion, using a vacuum de-organic solvent apparatus.

TABLE 16

| | Composition of dispersion N-1 |
|---|---|
| Oil phase | |
| Compound (B) | — |
| Compound (2) | 0.25 g |
| High-boiling solvent (1) | 4.8 g |
| High-boiling solvent (2) | — |
| High-boiling solvent (4) | — |
| Surfactant (1) | 1.0 g |
| Ethyl acetate | 10 ml |
| Aqueous phase | |
| Acid-processed gelatin | 10 g |
| Lime-processed gelatin | — |
| Antiseptic (1) | 0.025 g |

TABLE 16-continued

| | Composition of dispersion N-1 |
|---|---|
| Antiseptic ④ | — |
| Water | 136.7 ml |
| Antiseptic ⑤ | — |
| Total | 162 g |

Compound (B)

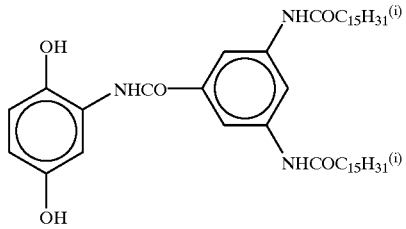

High-boiling solvent①

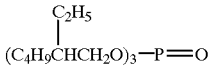

High-boiling solvent②

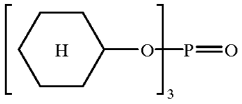

Surfactant①

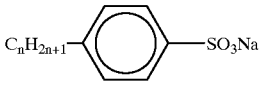

n ≈ 12.6

High-boiling solvent④

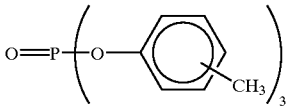

(m.p)

Antiseptic③

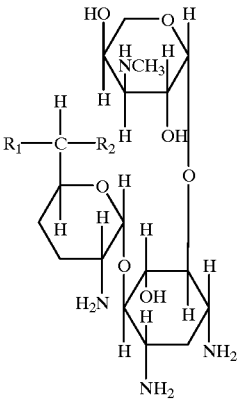

| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |

-continued

Antiseptic④

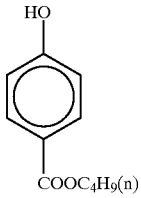

Antiseptic⑤

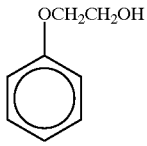

A method of preparing a gelatin dispersion of a dye-providing compound will be explained.

Gelatin dispersions of a yellow-dye-providing compound, a magenta-dye-providing compound, and a cyan-dye-providing compound were prepared according to the formulations shown in Table 17, respectively. Specifically, the oil phase components were heated to about 70° C. to dissolve them, thereby forming a uniform solution. To this solution, were added the aqueous phase components heated to about 60° C., followed by stirring to mix together. The resultant mixture was then dispersed using a homogenizer at 10,000 rpm for 10 minutes. To the thus-dispersed mixture was added additional water, followed by stirring to obtain a uniform dispersion. Moreover, the gelatin dispersion of the cyan-dye-providing compound was diluted with water and concentrated repeatedly by using a ultrafiltration module (Ultrafiltration Module ACV-3050, trade name, manufactured by Asahi Chemical Industry Co., Ltd.), such that the amount of ethyl acetate was reduced to 1/17.6 of the amount of ethyl acetate shown in Table 17.

TABLE 17

Gelatin dispersion of hydrophilic additives

| | Composition of dispersion | | |
|---|---|---|---|
| | Yellow | Magenta | Cyan |
| Oil phase | | | |
| Yellow-dye-providing compound ① | 1.68 g | — | — |
| Yellow-dye-providing compound ② | 4.03 g | — | — |
| Magenta-dye-providing compound ② | — | 5.27 g | — |
| Cyan-dye-providing compound ② | — | — | 4.45 g |
| Reducing agent ① | 0.47 g | 0.06 g | 0.29 g |
| Antifoggant ③ | 0.09 g | — | 0.06 g |
| Antifoggant ④ | — | 0.21 g | — |
| Surfactant ① | 0.6 g | 0.23 g | 0.45 g |
| High-boiling solvent ① | 0.84 g | — | 1.34 g |
| High-boiling solvent ② | 2.01 g | 2.63 g | 4.47 g |
| Development accelerator ① | 1.01 g | — | — |
| Dye (a) | 0.59 g | — | 0.14 g |
| Water | 0.22 ml | — | 0.3 g |
| Ethyl acetate | 10 ml | 16 ml | 16 ml |
| Cyan-dye-providing compound ③ | 0.009 g | — | — |

TABLE 17-continued

| Gelatin dispersion of hydrophilic additives | | | |
|---|---|---|---|
| | Composition of dispersion | | |
| | Yellow | Magenta | Cyan |
| Aqueous phase | | | |
| Lime-processed gelatin | 5.5 g | 3.1 g | 2.4 g |
| Calcium nitrate | 0.05 g | 0.04 g | — |
| Sodium hydroxide aqueous solution (1N) | — | — | 0.07 g |
| Carboxymethyl cellulose | — | — | 31 g |
| Water | 35 ml | 31 ml | 40 ml |
| Additional water (after emulsification) | 40 ml | 43 ml | 0.03 ml |
| Antiseptic (1) | 0.003 g | 0.002 g | 0.001 g |

Yellow-dye-providing compound (1)

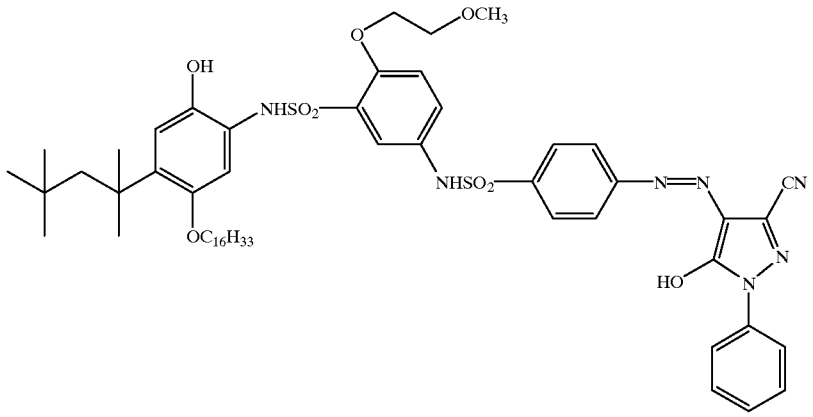

Yellow-dye-providing compound (2)

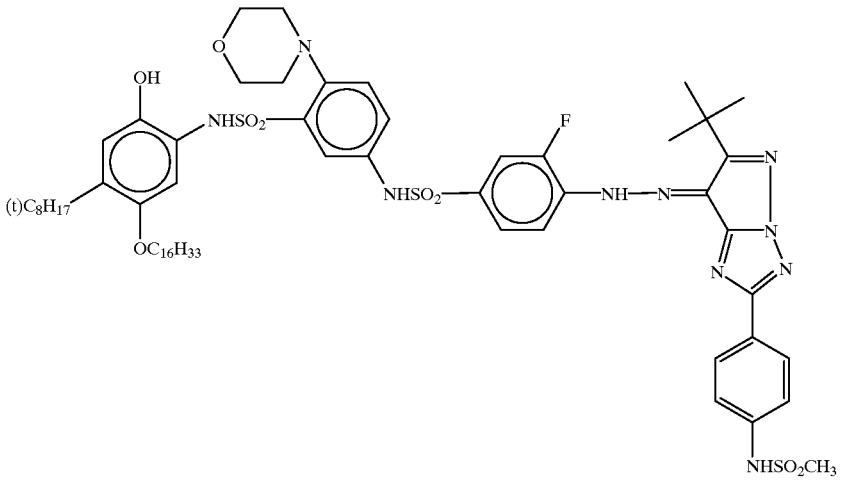

-continued
Magenta-dye-providing compound (2)
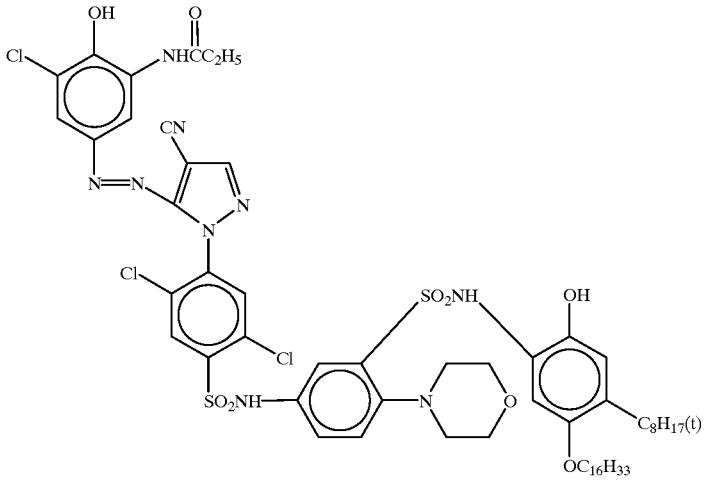
Cyan-dye-providing compound (2)
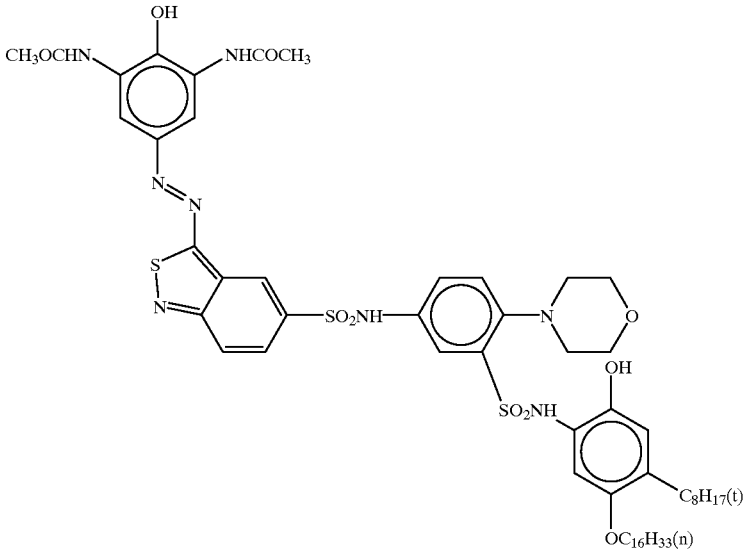
Cyan-dye-providing compound (3)
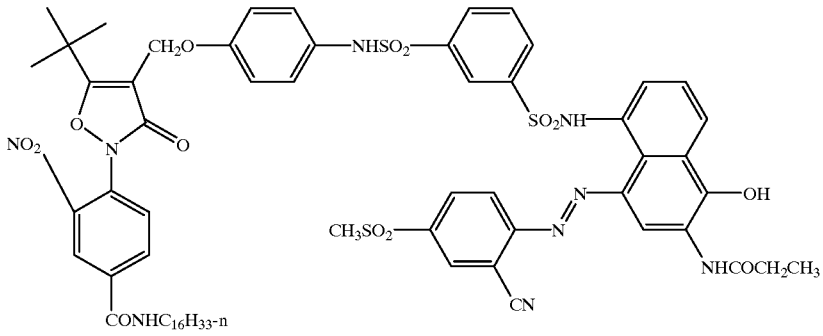

-continued

Reducing agent ①

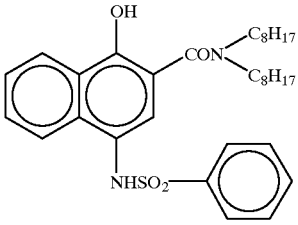

Antifoggant ③

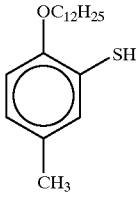

Antifoggant ④

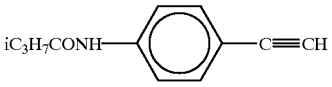

Development accelerator ①

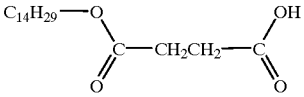

Dye (a)

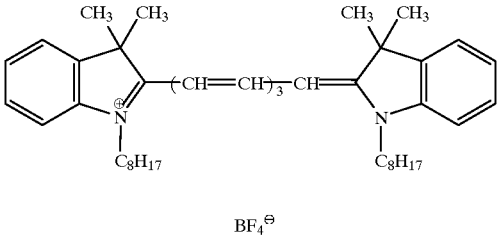

A gelatin dispersion of antifoggant ④ was prepared according to the formulation shown in Table 18. Specifically, oil phase components were heated to about 60° C. to dissolve them. To this solution were added the aqueous phase components heated to about 60° C., followed by stirring to mix them. The resultant mixture was then dispersed using a homogenizer at 10,000 rpm for 10 minutes, to obtain a uniform dispersion.

TABLE 18

| | Composition of dispersion |
|---|---|
| Oil phase | |
| Antifoggant ④ | 0.8 g |
| Reducing agent ① | 0.1 g |
| High-boiling solvent ② | 2.4 g |
| High-boiling solvent ③ | 0.2 g |
| Surfactant ① | 0.5 g |
| Surfactant ⑦ | 0.5 g |
| Ethyl acetate | 10.0 ml |
| Aqueous phase | |
| Lime-processed gelatin | 10.0 g |
| Antiseptic ① | 0.004 g |
| Calcium nitrate | 0.1 g |
| Water | 35.0 ml |
| Additional water | 46.0 ml |

A dispersion of the polymer latex a was prepared according to the formulation shown in Table 19. Specifically, an anionic surfactant ⑤ was added to a mixed solution containing a polymer latex (a), a surfactant ① and water in the amounts shown in Table 19, with stirring, over 10 min, to obtain a uniform dispersion. Further the resulting dispersion was diluted with water and concentrated repeatedly, by using a ultrafiltration module (Ultrafiltration Module ACV-3050, trade name, manufactured by Asahi Chemical Industry Co., Ltd.) such that the concentration of a salt in the dispersion was adjusted to 1/9.

TABLE 19

| | Composition of dispersion |
|---|---|
| Polymer Latex (a) aqueous solution (solid content 13%) | 108.0 ml |
| Surfactant ④ | 20.0 g |
| Anionic surfactant ⑤ aqueous solution(5%) | 600.0 ml |
| Water | 1232.0 ml |

A gelatin dispersion of stabilizer ① was prepared according to the formulation shown in Table 20. Specifically, oil phase components were dissolved at room temperature. To this solution were added the aqueous phase components heated to about 40° C., followed by stirring to mix. The resulting mixture was then dispersed using a homogenizer at 10,000 rpm for 10 minutes. Additional water was added thereto, followed by stirring, to obtain a uniform dispersion.

TABLE 20

| | Composition of dispersion |
|---|---|
| Oil phase | |
| Stabilizer ① | 4.0 g |
| Sodium hydroxide | 0.3 g |
| Methanol | 62.8 g |
| High-boiling solvent ② | 0.9 g |

TABLE 20-continued

| | Composition of dispersion |
|---|---|
| Aqueous phase | |
| Gelatin from which calcium had been removed (Ca content 100 ppm or less) | 10.0 g |
| Antiseptic (1) | 0.04 g |
| Water | 320.5 ml |

A gelatin dispersion of zinc hydroxide was prepared according to the formulation shown in Table 21. Specifically, each component was mixed and dissolved together, and then, they were dispersed using glass beads having an average particle diameter of 0.75 mm in a mill for 30 minutes. Further, the glass beads were separated and removed off, to obtain a uniform dispersion (zinc hydroxide having an average particle size of 0.25 $\mu$m was used).

TABLE 21

| | Composition of dispersion |
|---|---|
| Zinc hydroxide | 15.9 g |
| Carboxymethyl cellulose | 0.7 g |
| Poly(sodium acrylate) | 0.21 g |
| Lime-processed gelatin | 4.2 g |
| Water | 100 ml |
| High-boiling solvent (2) | 0.4 g |

A method of preparing a gelatin dispersion of a matt agent to be added to the protective layer will be mentioned. A solution obtained by dissolving a PMMA in methylene chloride was added to a gelatin together with a small amount of a surfactant, and the resultant mixture was dispersed with high speed stirring. In succession, methylene chloride was removed off by a vacuum de-solvent apparatus, to obtain a uniform dispersion having an average particle size of 4.3 $\mu$m.

High-boiling organic solvent (3)

$C_{24}H_{44}Cl_6$
EMPARA 40
(trade name: manufactured by Ajinomoto K.K.)

Surfactant (7)

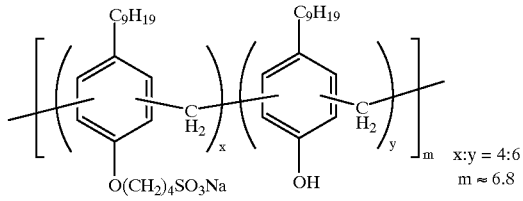

Polymer Latex a

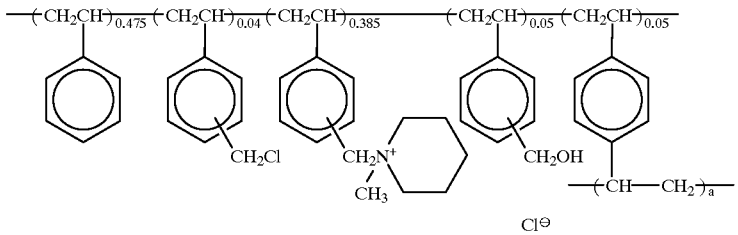

Surfactant (2)

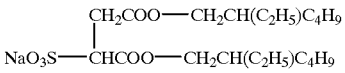

Surfactant (3)

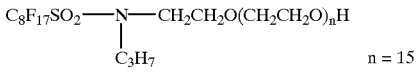

Surfactant (5)

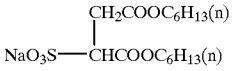

Surfactant (6)

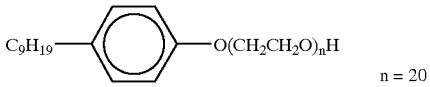

Antifoggant (5)

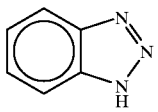

Using the thus-obtained materials, a heat-developable color light-sensitive material 101 shown in Table 22 was produced. Incidentally, a sensitizing dye, an antifoggant, and additives in a slight amount, such as a mildew-proofing agent, each of which was added together with the light-sensitive silver halide, are omitted in the following table.

TABLE 22

Constitution of Light-Sensitive Material 101

| Number of layer | Name of layer | Additive | Coated amount (mg/m$^2$) |
|---|---|---|---|
| Eighth layer | Protective layer | Acid-processed gelatin | 1436 |
| | | Matt agent(PMMA resin) | 19 |
| | | Surfactant (2) | 36 |
| | | Surfactant (3) | 13 |
| | | Surfactant (1) | 6 |
| | | Calcium nitrate | 7 |
| Seventh layer | 680-nm light-sensitive layer | Lime-processed gelatin | 389 |
| | | Light-sensitive silver halide emulsion (1) | 260 |
| | | Magenta-dye-providing compound (2) | 444 |
| | | High-boiling solvent (2) | 254 |
| | | Reducing agent (1) | 5.3 |
| | | Antifoggant (4) | 18 |
| | | Surfactant (1) | 27 |
| | | Water-soluble polymer (1) | 8.4 |
| Sixth layer | Intermediate layer | Lime-processed gelatin | 482 |
| | | Zinc hydroxide | 864 |
| | | Surfactant (2) | 3.5 |
| | | Water-soluble polymer (1) | 4.8 |
| | | Calcium nitrate | 9.1 |
| Fifth layer | 750-nm light-sensitive layer | Lime-processed gelatin | 330 |
| | | Light-sensitive silver halide emulsion (2) | 150 |
| | | Stabilizer (1) | 11.3 |
| | | Cyan-dye-providing compound (2) | 350 |
| | | Dye (a) | 11 |
| | | High-boiling solvent (1) | 105 |
| | | High-boiling solvent (2) | 351 |
| | | Reducing agent (1) | 23 |
| | | Antifoggant (3) | 4.3 |
| | | Surfactant (1) | 49 |
| | | Carboxymethyl cellulose | 5.8 |
| | | Water-soluble polymer (1) | 6.4 |
| Forth layer | Intermediate layer | Lime-processed gelatin | 393 |
| | | Antifoggant (5) | 3.9 |
| | | Surfactant (1) | 7.4 |
| | | Surfactant (2) | 4.1 |
| | | Surfactant (6) | 19 |
| | | Surfactant (7) | 5 |
| | | High-boiling solvent (2) | 26 |
| | | High-boiling solvent (3) | 2.6 |
| | | Reducing agent (1) | 1.1 |
| | | Water-soluble polymer (2) | 13 |
| | | Calcium nitrate | 6 |
| Third layer | 810-nm light-sensitive layer | Lime-processed gelatin | 610 |
| | | Light-sensitive silver halide emulsion (3) | 329 |
| | | Fine grain silver chloride | 42 |
| | | Stabilizer (1) | 8.8 |
| | | Yellow-dye-providing compound (1) | 130 |
| | | Yellow-dye-providing compound (2) | 312 |
| | | Cyan-dye-providing compound (3) | 0.7 |
| | | Sensitizing dye (3) | 0.1 |
| | | Dye (a) | 46 |
| | | High-boiling solvent (1) | 70 |
| | | High-boiling solvent (2) | 156 |
| | | Surfactant (1) | 62 |
| | | Reducing agent (1) | 36 |
| | | Development accelerator (1) | 78 |
| | | Antifoggant (3) | 6.8 |
| | | Water-soluble polymer (2) | 45 |
| | | Hardener (1) | 59 |

TABLE 22-continued

Constitution of Light-Sensitive Material 101

| Number of layer | Name of layer | Additive | Coated amount (mg/m$^2$) |
|---|---|---|---|
| Second layer | Intermediate layer | Lime-processed gelatin | 265 |
| | | Antifoggant (5) | 2.6 |
| | | Surfactant (1) | 5 |
| | | Surfactant (2) | 2.8 |
| | | Surfactant (6) | 33 |
| | | Surfactant (7) | 3.6 |
| | | High-boiling solvent (2) | 18 |
| | | High-boiling solvent (3) | 1.8 |
| | | Reducing agent (1) | 0.7 |
| | | Water-soluble polymer (2) | 8.8 |
| | | Calcium nitrate | 4 |
| First layer | Intermediate layer | Lime-processed gelatin | 224 |
| | | High-boiling solvent (4) | 72 |
| | | Surfactant (1) | 17 |
| | | Sodium hydrogensulfite | 2.7 |
| | | Compound (B) | 119 |
| Base (Paper support whose both surfaces had been laminated with polyethylene: thickness 135 $\mu$m) | | | |

Sensitizing dye (3)

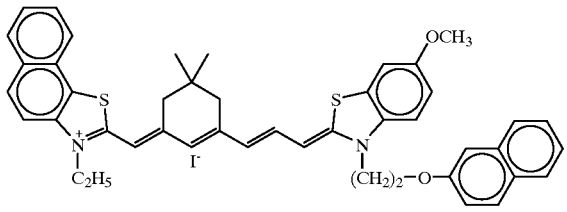

Hardener (1)

$CH_2{=}CHSO_2CH_2SO_2CH{=}CH_2$

Light-sensitive materials 102 to 104 were prepared in the same manner as in the preparation of the light-sensitive material 101, except that the gelatin dispersion of Compound (2) was added. The number of the exemplified compound, the amount to be added and the layer to which the compound was added, are shown in Table 23.

TABLE 23

| Sample No. | Emulsion No. | Exemplified compound | Added amount (mg/m$^2$) | Added layer | Remarks |
|---|---|---|---|---|---|
| 101 | None | None | — | — | Comparative example |
| 102 | N-1 | (2) | 2 | Eighth layer | This invention |
| 103 | N-1 | (2) | 4 | Eighth layer | This invention |
| 104 | N-1 | (2) | 8 | Eighth layer | This invention |

A way of the preparation of the dye-fixing element will be explained. By multilayer-containg, the layer structure shown in Table 25 was provided on the surface of a support shown in Table 24, to prepare an image-receiving material (dye-fixing element) 201.

TABLE 24

Constitution of Base (Support)

| Name of layer | Composition | Film thickness (μm) |
|---|---|---|
| Surface undercoat layer | Gelatin | 0.1 |
| Surface PE layer (Glossy) | Low-density polyethylene (Density 0.923):90.2 parts<br>Surface-treated titanium oxide: 9.8 parts<br>Ultramarine: 0.001 parts | 36.0 |
| Pulp layer | Fine quality paper (LBKP/NBSP = 6/4, Density 1.053) | 152.0 |
| Back-surface PE layer (Matt) | High-density polyethylene (Density 0.955) | 27.0 |
| Back-surface undercoat layer | Colloidal silica | 0.03 |
| | Alumina sol | 0.15 |
| | Polyvinyl alcohol | 0.5 |
| | Compound (A) | 0.002 |
| | Total thickness | 215.6 |

TABLE 25

Constitution of Dye-fixing Element 201

| Number of layer | Additive | Coated amount ($mg/m^2$) |
|---|---|---|
| Sixth layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-preventing agent (1) | 7 |
| | Stain-preventing agent (2) | 12 |
| | Matt agent (1) | 7 |
| Fifth layer | Gelatin | 250 |
| | Water-soluble polymer (1) | 25 |

TABLE 25-continued

Constitution of Dye-fixing Element 201

| Number of layer | Additive | Coated amount ($mg/m^2$) |
|---|---|---|
| | Anionic surfactant (3) | 9 |
| | Hardener (1) | 185 |
| Forth layer | Mordant (1) | 1850 |
| | Water-soluble polymer (2) | 260 |
| | Water-soluble polymer (4) | 1400 |
| | Dispersion of latex (1) | 600 |
| | Anionic surfactant (3) | 25 |
| | Nonionic surfactant (1) | 18 |
| | Citric acid | 15 |
| | Picolinic acid | 60 |
| | Guanidine picolinate | 2550 |
| | Sodium quinolinate | 350 |
| Third layer | Gelatin | 370 |
| | Mordant (1) | 300 |
| | Anionic surfactant (3) | 12 |
| Second layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | High-boiling organic solvent (1) | 700 |
| | Brightening agent (1) | 30 |
| | Guanidine picolinate | 360 |
| | Potassium quinolinate | 45 |
| First layer | Gelatin | 280 |
| | Water-soluble polymer (1) | 12 |
| | Anionic surfactant (1) | 14 |
| | Sodium metaborate | 35 |
| | Hardener (1) | 185 |
| Base Paper Base in Table 24 (thickness 215 μm) | | |

The coated amount of the dispersion of latex is in terms of the coated amount of the solid content of latex.

Anionic surfactant (1)

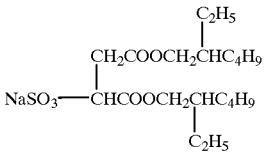

Anionic surfactant (2)

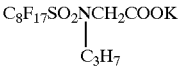

Anionic surfactant (3)

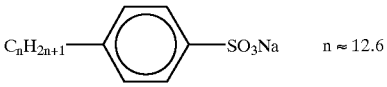

Compound (A)

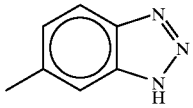

Anionic surfactant (4)

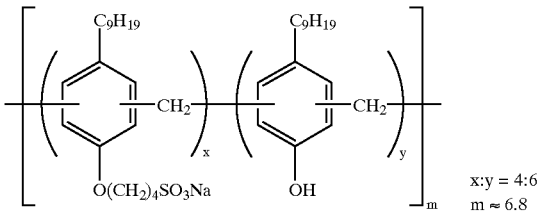

Nonionic surfactant (1)

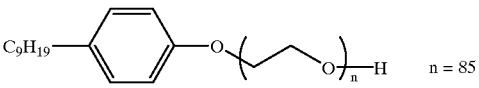

-continued

Amphoteric surfactant (1)

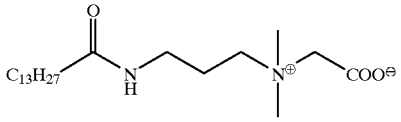

Brightening agent (1)

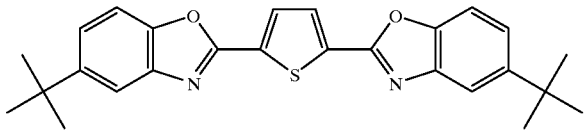

Stain-preventing agent (1)

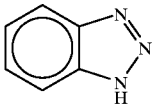

Stain-preventing agent (2)

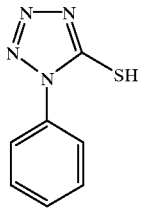

Stain-preventing agent (3)

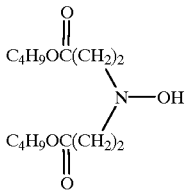

High-boiling organic solvent (1)

$C_{28}H_{48.9}Cl_{7.1}$
EMPARA 40
(trade name: manufactured by Ajinomoto K.K.)

Water-soluble polymer (1)

Sumikagel L5-H
(trade name: manufactured by Sumitomo Kagaku Co.)

Water-soluble polymer (2)

Dextran
(molecular weight 70,000)

Water-soluble polymer (3)

κ (kappa)-Carrageenan
(trade name: manufactured by Taito Co.)

Water-soluble polymer (4)

MP Polymer MP-102
(trade name: manufactured by Kuraray Co.)

Dispersion of latex (1)

LX-438
(trade name: manufactured by Nippon Zeon Co.)

Mordant (1)

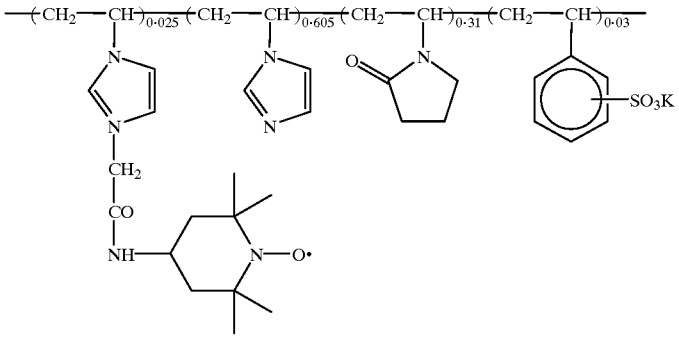

Matt agent (1)

SYLOID79
(trade name: manufactured by Fuji Davisson Kagaku Co.)

Hardener (1)

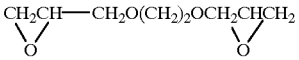

The above light-sensitive material 101 was combined with the dye-fixing element 201, and the development thereof was carried out using a Pictrography 3000 (trade name) put on the market by Fuji Photo Film Co., Ltd. The development was carried out in a standard developing condition or at 89° C., to measure the fogging of magenta, respectively, by using a reflection densitometer X-Rite 310 (trade name; filter: Status A). The light-sensitive materials 102 to 104 were processed in the same manner as in the case of the light-sensitive material 101. The results are shown in Table 26.

It can be understood from the results shown in Table 26 that the light-sensitive materials of the present invention are excellent heat-developable color light-sensitive materials less in the variation of fogging with variation of the developing temperature during thermal development.

TABLE 26

| Light-Sensitive Material No. | Fogging (Magenta) Standard development (83° C.) | Developing temperature (89° C.) |
|---|---|---|
| 101 (Comparative example) | 0.105 | 0.190 |
| 102 (This invention) | 0.104 | 0.140 |
| 103 (This invention) | 0.104 | 0.141 |
| 104 (This invention) | 0.104 | 0.140 |

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-developable color light-sensitive material containing at least, on a support, a light-sensitive silver halide emulsion, a binder, and a dye-providing compound, wherein the light-sensitive material contains at least one compound represented by formula (I):

formula (I)

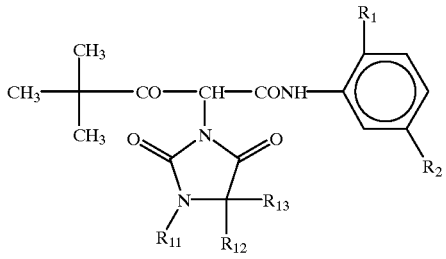

wherein the at least one compound represented by formula (I) is added to a protective layer in an amount of 0.01 mg/m$^2$ or more and 200 mg/m$^2$ or less, and wherein $R_1$ represents a chlorine atom or an alkoxy group, $R_2$ represents an acylamino group or an alkoxycarbonyl group, $R_{11}$ represents a hydrogen atom or an alkyl group, $R_{12}$ and $R_{13}$ each represent a hydrogen atom, an alkyl group, or an alkoxy group, in which $R_{12}$ and $R_{13}$ may be the same or different from, and wherein the material does not contain any aminophenols as an electron-transfer agent.

2. The heat-developable color light-sensitive material according to claim 1, wherein $R_1$ is a chlorine atom or an alkoxy group having 1–30 carbon atoms, $R_2$ is an acylamino group having 1–30 carbon atoms, or an alkoxycarbonyl group having 2–31 carbon atoms, $R_{11}$ is a hydrogen atom or an alkyl group having 1–30 carbon atoms, $R_{12}$ and $R_{13}$ each represent a hydrogen atom, an alkyl group having 1–30 carbon atoms or an alkoxy group having 1–30 carbon atoms, in which $R_{12}$ and $R_{13}$ may be the same or different, and wherein the material does not contain any aminophenols as an electron-transfer agent.

3. The heat-developable color light-sensitive material according to claim 1, wherein the compound represented by formula (I) has a ballasting group in a molecule thereof.

4. The heat-developable color light-sensitive material according to claim 1, wherein the compound represented by formula (I) is contained in the protective layer, by dispersing in an aqueous medium in the state dissolved in a high-boiling point organic solvent.

5. The heat-developable color light-sensitive material according to claim 1, wherein the compound represented by formula (I) is a compound selected from the group consisting of the followings:

| Compound | $R_1$ | $R_2$ | $R_{11}$ | $R_{12}$ | $R_{13}$ |
|---|---|---|---|---|---|
| 1 | Cl | A | $PhCH_2$ | $CH_3O$ | H |
| 2 | Cl | A | $PhCH_2$ | $C_2H_5O$ | H |
| 3 | Cl | B | $PhCH_2$ | $CH_3O$ | H |
| 4 | Cl | A | H | $CH_3$ | $CH_3$ |
| 5 | Cl | n-$C_{17}H_{35}CONH$ | H | $CH_3$ | $CH_3$ |
| 6 | Cl | n-$C_{17}H_{35}CONH$ | $PhCH_2$ | $C_2H_5O$ | H |
| 7 | $CH_3O$ | A | $PhCH_2$ | $C_2H_5O$ | H |
| 8 | $CH_3O$ | n-$C_{14}H_{29}OCO$ | $CH_3$ | $C_6H_{13}O$ | H |
| 9 | $CH_3O$ | n-$C_{14}H_{29}OCO$ | $CH_3$ | $C_2H_5O$ | H |
| 10 | Cl | $C_8H_{17}CH(C_8H_{17})CONH$ | $PhCH_2$ | $C_2H_5O$ | H |
| 11 | Cl | $C_8H_{17}CH(C_8H_{17})CONH$ | H | $CH_3$ | $CH_3$ |

wherein

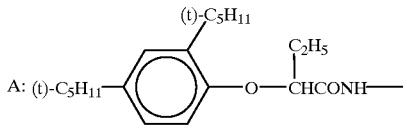

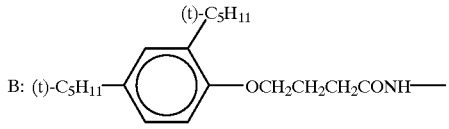

6. The heat-developable color light-sensitive material according to claim 1, wherein the dye-providing compound is a coupler.

7. The heat-developable color light-sensitive material according to claim 1, wherein the dye-providing compound is a DRR compound.

8. The heat-developable color light-sensitive material according to claim 1, wherein the at least one compound represented by formula (I) is added to a protective layer in an amount of 0.01 mg/m$^2$ to 100 mg/m$^2$.

* * * * *